United States Patent [19]

Cunningham

[11] Patent Number: 4,817,361

[45] Date of Patent: Apr. 4, 1989

[54] CARRIER ASSEMBLING APPARATUS

[75] Inventor: Ernest R. Cunningham, Libertyville, Ill.

[73] Assignee: Grip-Pak, Inc., Libertyville, Ill.

[21] Appl. No.: 156,367

[22] Filed: Feb. 16, 1988

[51] Int. Cl.[4] ..... B65B 27/04; B65B 21/00

[52] U.S. Cl. ..... 53/48; 53/556

[58] Field of Search ..... 53/48, 556, 441, 398

[56] References Cited

U.S. PATENT DOCUMENTS

| | | | |
|---|---|---|---|
| 3,032,944 | 5/1962 | Hull et al. | 53/556 X |
| 3,816,968 | 6/1974 | Morgan et al. | 53/48 |
| 4,079,571 | 3/1978 | Schlueter | 53/48 |

*Primary Examiner*—Willie G. Abercrombie

*Attorney, Agent, or Firm*—Michael, Best & Friedrich

[57] ABSTRACT

An apparatus for installing a plastic carrier onto a plurality of side-by-side cans includes a pair of canted discs arranged for rotation around non-coincident intersecting axes. A number of shoes around the periphery of each disc, engage opposite edges of the carrier and expand the carrier as the discs rotate, while a conveyor moves the side-by-side cans into registry with the expanded carrier. A rolling depressor, between the discs, presses downwardly on the expanded carrier, urging the carrier away from the shoes and onto the cans.

25 Claims, 4 Drawing Sheets

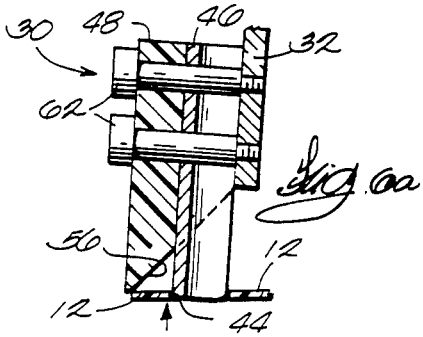
Fig. 6a
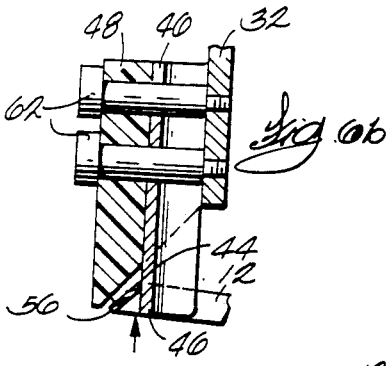
Fig. 6b
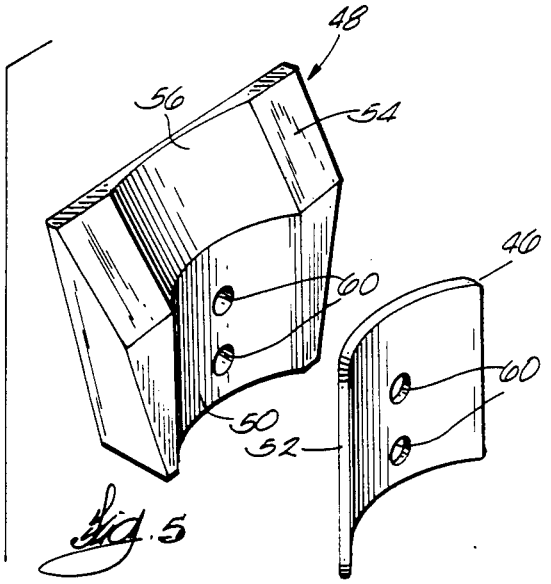
Fig. 5
Fig. 4
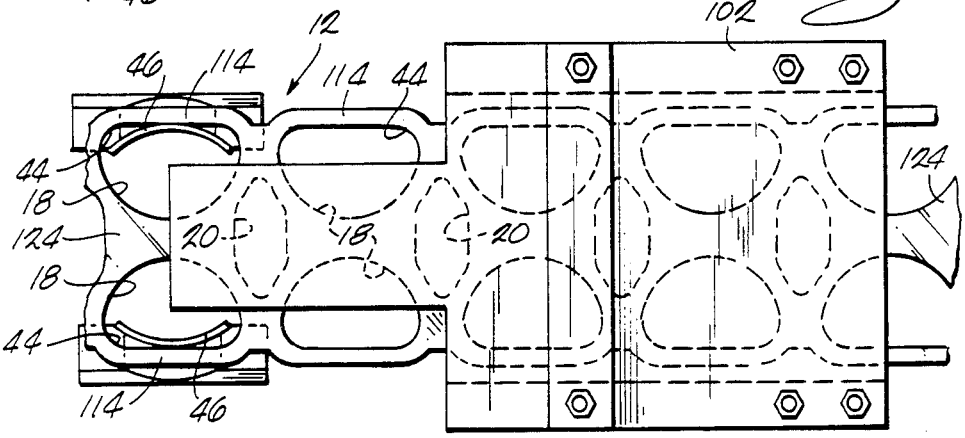
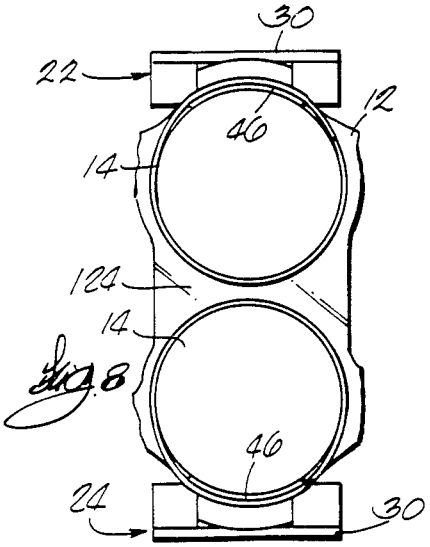
Fig. 8
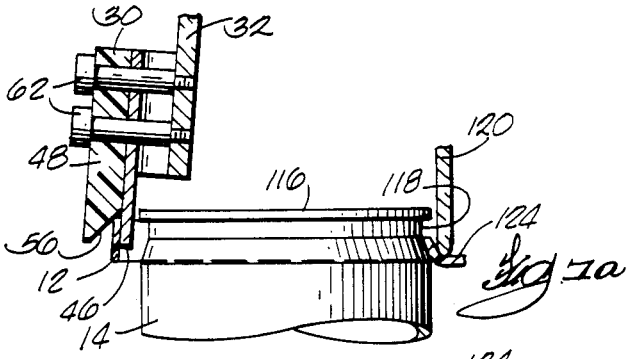
Fig. 7a
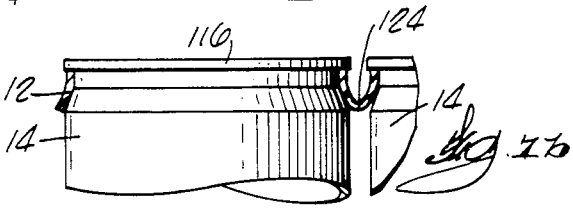
Fig. 7b

CARRIER ASSEMBLING APPARATUS

BACKGROUND OF THE INVENTION

This invention relates generally to machinery for assembling plastic carriers onto containers to form conveniently handled multipacks.

Plastic carriers, such as are disclosed in U.S. Pat. Nos. 4,462,494 and 4,219,117 in the form of an apertured plastic sheet or strip, are well-known in the art and provide a convenient, inexpensive way to retain individual containers in multipacks. Such carriers are particularly useful in the brewing and soft-drink canning industries and are used to retain cans so as to form the six, eight and twelve packs familiar to purchasers of such goods. Although such packages can be assembled by hand when relatively few cans are involved, hand assembly is impractical in commercial brewing or canning operations wherein thousands of cans are processed per hour. Thus, various machines have been proposed for automatically assembling plastic carriers onto containers with speed, reliability and economy.

One known form of carrier assembling machine is shown, or example, in U.S. Pat. No. 3,032,944 to Hull et al., and is typified by a rotating drum around which a number of carrier aperture expanding jaws are mounted. The jaws are axially slideable along a plurality of guide rods, and a pair of cams adjacent opposite ends of the drum function to drive the jaws toward and away from each other as the drum rotates, thereby expanding the carrier for assembly onto the cans. Although effective, such machines are complex, expensive and, because of their many sliding elements, prone to wear and increased maintenance costs.

Another known form of carrier assembling machine is shown, for example, in U S. Pat. No. 4,250,682 to Braun and is also typified by a rotating drum having thereon mounted a number of carrier aperture expanding jaws. However, and in contrast to the earlier-described machine, only half of the expanding jaws are axially slideable in response to rotation of the drum, the remaining jaws being axially fixed. Although this construction reduces, by one-half, the number of sliding elements, a number of sliding elements nevertheless remain. Though an improvement, such a machine is, nevertheless, still prone to wear and increased maintenance costs.

An alternative approach to assembling Plastic carriers to containers is shown in the inventor's U.S. Pat. No. 3,383,828. In this approach, a plurality of pin elements are adapted to engage the carrier and are driven so as to transcribe arcuate paths and thereby expand the carrier for assembly onto the containers. Although effective, this mechanism, too, is complex, prone to wear, and can lead to increased maintenance costs.

In view of the foregoing, it is a general object of the present invention to provide a new and improved apparatus for assembling carriers onto containers.

It is a more specific object of the present invention to provide a new and improved carrier assembling machine capable of economical manufacture and operation.

It is a still more specific object of the present invention to provide a new and improved carrier assembling machine wherein sliding movement of carrier aperture expanding elements is eliminated.

SUMMARY OF THE INVENTION

The invention provides an apparatus for installing a plastic carrier on a plurality of containers arranged in side-by-side relationship to each other. The apparatus comprises first and second pluralities of engaging elements adapted to engage the carrier and arranged to rotate around non-coincident, substantially intersecting axis so as to stretch the carrier for installation onto the containers. More specifically, the engaging elements are arranged on two discs that rotate on axes which diverge from each other by a small angle so that the distance between any pair of engaging elements varies according to the phase of the synchronized cycle of the two discs. The exact size of the said angle of divergence is dependent solely on the size of the discs and the degree of stretch required to ensure that the carrier aperture is large enough to encircle the container in question.

The invention thus provides an apparatus for installing a plastic carrier on a plurality of substantially cylindrical containers arranged in side-by-side relationship. The apparatus comprises structure defining a pair of first and second, non-coincident, substantially intersecting axes, and further comprises a first rigid disc mounted for rotation around the first axis. A second rigid disc is mounted for rotation around the second axis, and a drive mechanism is provided for simultaneously rotating the first and second discs in the same direction, and at substantially the same speed, around the first and second axes. Engaging elements are provided adjacent the outer peripheries of the first and second discs for engaging opposite sides of the carrier so that the carrier is stretched between the outer peripheries of the first and second discs as the discs rotate.

It is a principal feature of the present invention to provide a carrier assembling machine wherein a pair of opposed, canted, disc-like elements, having outer peripheries adapted to engage opposite sides of an apertured carrier, rotate around non-coincident, substantially intersecting axes, in a more specific aspect the disc-like elements rotate or slightly divergent axes, so as to expand the carrier through divergence of the peripheries in response to rotation of the discs.

It is another principal feature of the present invention to provide a carrier assembling machine wherein the expanded carrier is disengaged from the carrier expanding elements at least in part by means of an idling roller positioned substantially between the canted discs and engaging the carrier substantially along the midline thereof.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 3 is a fragmentary side-elevational view of an alternative embodiment of the carrier assembling apparatus.

FIG. 4 is a cross-sectional view of the carrier assembling apparatus shown in FIG. 3, taken along line 4—4 thereof.

FIG. 5 is a exploded perspective view of a carrier engaging shoe assembly incorporated in the carrier expander assembly shown in FIGS. 1 and 2.

FIGS. 6*a* and 6*b* are transitional, cross-sectional views of a representative one of the carrier engaging shoes incorporated in the carrier expanding assembly, useful in understanding the operation thereof.

FIGS. 7*a* and 7*b* are transitional fragmentary cross-sectional views of the carrier expander assembly shown in FIG. 2 taken along line 7—7 thereof and showing, in detail, the assembly of an expanded carrier onto a cylindrical container.

FIG. 8 is a cross-sectional view of the carrier expander assembly shown in FIG. 1 taken along line 8—8 thereof.

DESCRIPTION OF THE PREFERRED EMBODIMENT

Figure 2:
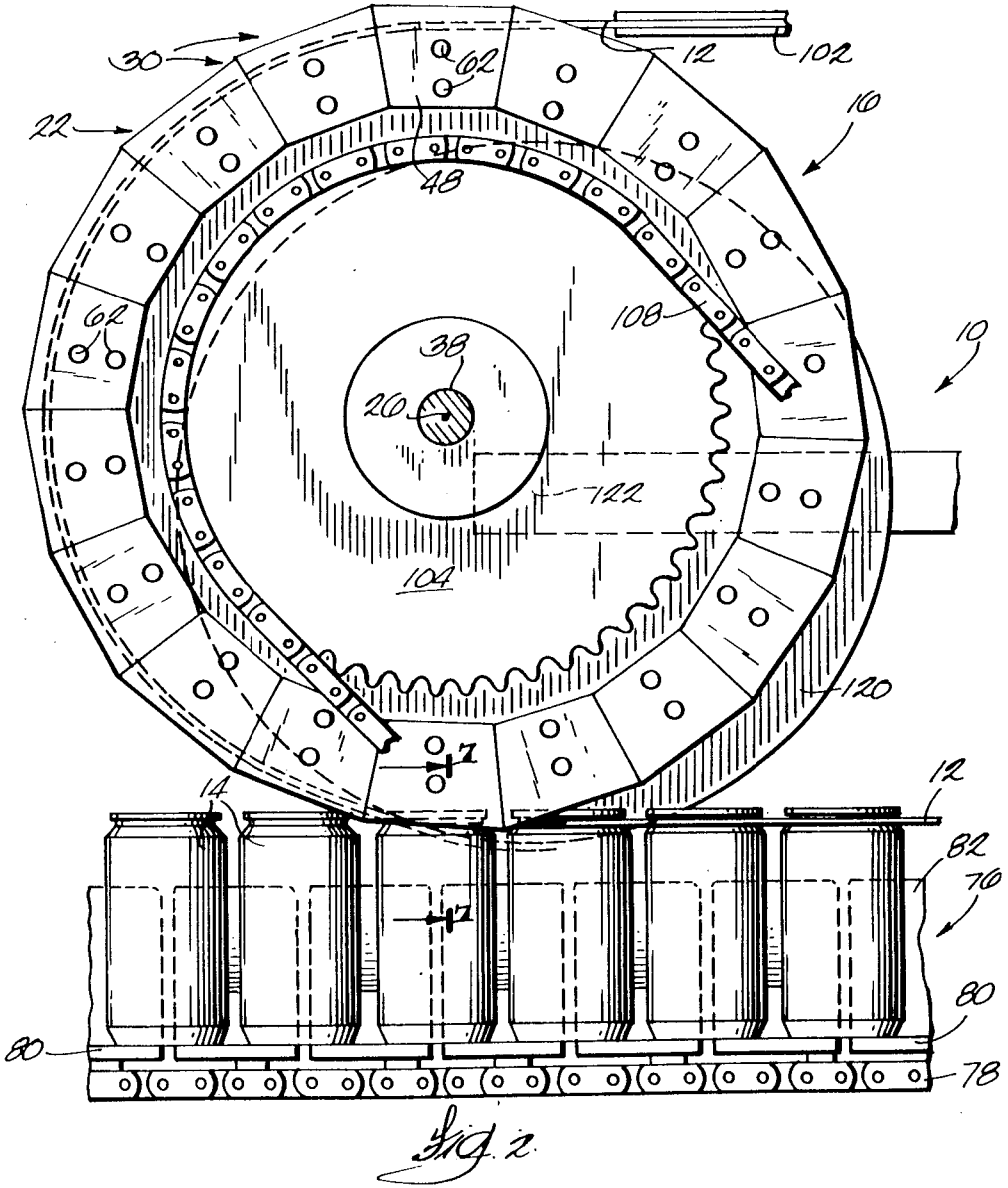
FIG. 2 is a side-elevational view of the carrier expander assembly shown in FIG. 1.
Figure 1:
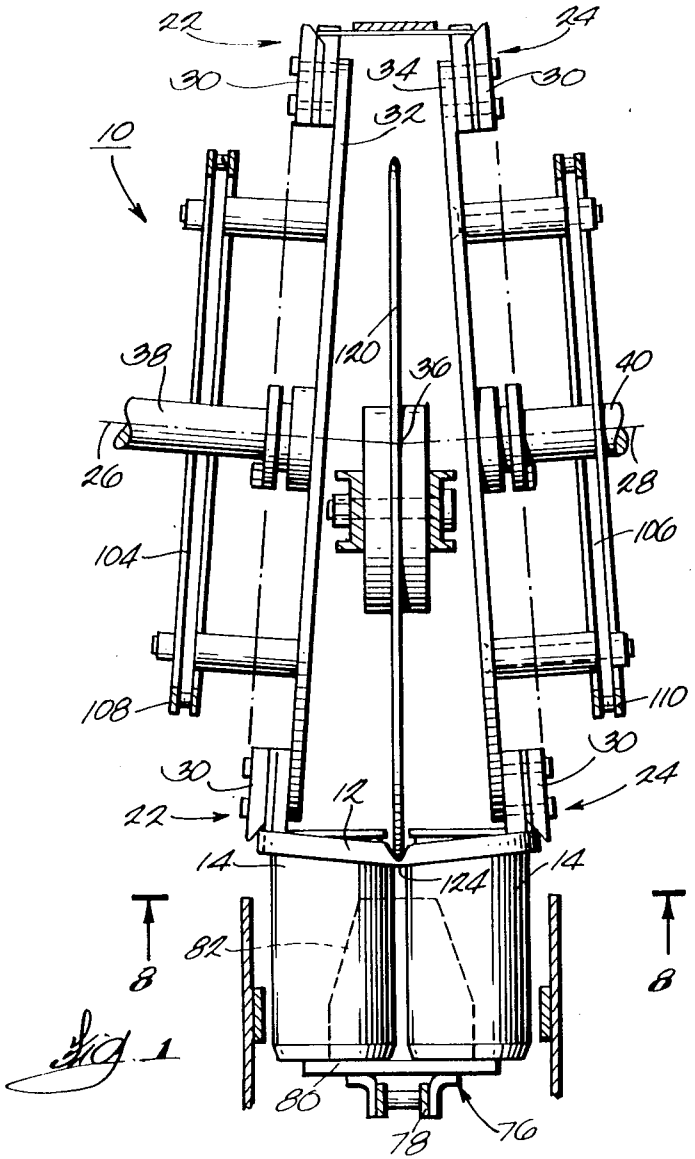
FIG. 1 is a front-elevational view of a canted-disc carrier expander assembly incorporated in a carrier assembling apparatus embodying the invention.
Figure 3:
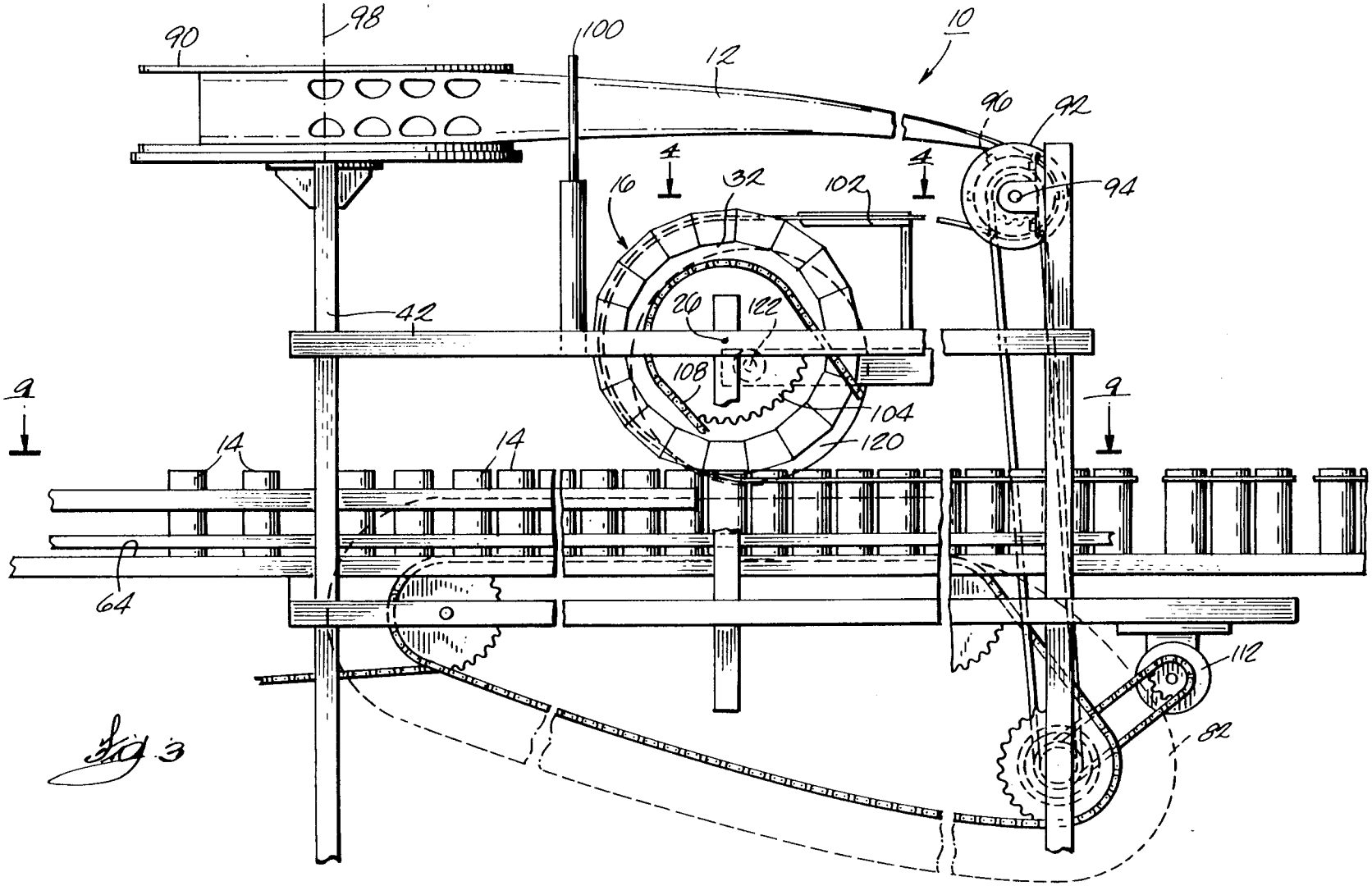
FIG. 3 is a fragmentary side-elevational view of the carrier assembling apparatus incorporating the carrier expander assembly shown in FIGS. 1 and 2.

Referring to the drawings, and, in particular, to FIGS. 1, 2 and 3, an apparatus 10 for assembling a plastic carrier 12 onto a plurality of cylindrical containers, such as, for example, twelve ounce beer or soft-drink cans 14, is illustrated. In accordance with one aspect of the invention, the carrier assembling apparatus 10 includes a canted-disc carrier expander assembly 16 operable to expand the carrier 12 for assembly with the side-by-side cans 14.

As best illustrated in FIG. 4, the carrier 12 comprises an elongate, die-cut strip of flexible, somewhat resilient plastic, such as polyethylene, having two rows of generally semi-circular cutouts formed along its opposite side edges. Each of the cutouts forms an aperture 18 which can be expanded so as to fit around the upper end of one of the cans 14. The apertures 18 are formed in opposed pairs across the width of the strip to retain the cans in side-by-side relationship, and additional cutouts or finger holes 20 are formed between adjacent aperture pairs to permit convenient grasping of the assembled package or pack.

Referring to FIG. 1, the canted-disc carrier expander assembly 16, in accordance with one aspect of the invention, generally comprises first and second pluralities 22 and 24 of carrier engaging members adapted to engage the carrier 12 and arranged to rotate around non-coincident, substantially intersecting axes 26 and 28, respectively, so as to expand the carrier 12 for installation onto the containers or cans 14. In the illustrated embodiment, the carrier engaging members comprise individual shoe assemblies or elements 30 mounted along the outer peripheries of a pair of rigid, substantially planar, canted, first and second discs 32 and 34 of substantially similar dimension. The discs 32 and 34 are arranged for rotation around the respective first and second axes 26 and 28 which, as illustrated, are oriented so that the discs 32 and 34 are relatively opposed to each other, with the spacing between the outer peripheries of the discs being greatest at the lower end of the expander assembly 16 and least at the upper end of the expander assembly 16. To this end, the first and second axes 26 and 28 are oriented so as to be non-coincident and so as to substantially intersect at a point 36 substantially midway between the two discs.

To rotatably support the first and second discs 32 and 34 in the desired orientation, the carrier expander assembly includes first and second rotatable shafts 38 and 40 coupled, respectively, to the centers of the first and second discs, and extending, respectively, along portions of the first and second axes 26 and 28.

The first and second shafts 38 and 40 are supported by means of a horizontal support 42 (FIG. 1) extending along each side of the carrier assembling apparatus 10 and are journaled for rotation around their respective axes.

In further accordance with one aspect of the invention, means are provided for rotating each of the first and second discs 32 and 34 around their respective first and second axes 26 and 28 in the same direction and at substantially the same speed. When so rotated, opposed ones of the shoe assemblies 30 mounted along the peripheries of the first and second discs 32 and 34 remain opposite each other as the discs rotate, and move outwardly away from each other as the opposed shoe assemblies 30 pass from the point of minimum spacing to the point of maximum spacing between the peripheries of the first and second discs. Accordingly, the portion of the carrier 12 supported between any opposed pair of shoe elements 30 is expanded as the shoe elements pass from the point of minimum spacing to the point of maximum spacing. Preferably, the orientation of the first and second axes 26 and 28, and the spacing between the first and second discs 32 and 34, is such that the minimum spacing between the opposed shoe elements 30 is substantially equal to the spacing between the inner edges 44 of the carrier apertures 18 in an unexpanded carrier (FIG. 4), while the maximum spacing is sufficient to enable the carrier apertures 18 to fit comfortably over the upper ends of the side-by-side of cans 14.

The shoe assemblies 30 are shown in FIG. 5. As illustrated, each shoe assembly 30 comprises a holding plate portion 46, preferably formed of a durable metal such as stainless steel, and a carrier support 48, preferably formed of a durable plastic material. The holding plate 46 is curved to a constant radius slightly larger than the can radius, and the carrier support 48 includes an inner face 50 shaped to conform to the curved outer face 52 of the holding plate 46. In addition, the inner upper edge 54 of the carrier support 48 is chamfered and includes an arcuate recess 56 opposite, and somewhat below, the uppermost edge 58 of the holding plate 46. Coincident holes 60 are formed through both the carrier support 48 and the holding plate 46 to permit the holding plate 46 to be fastened to each disc 32 and 34 with a pair of screws 62 (FIGS. 6*a* and 6*b*) or other fasteners. As illustrated, the shoe assemblies 30 are fastened to the first and second discs 32 and 34 so that the metal holding plate 46 are sandwiched between the discs 32 and 34 and the plastic carrier supports 48, and so that the holding plate 46 extends generally along radii of the discs 32 and 34.

Figure 9:
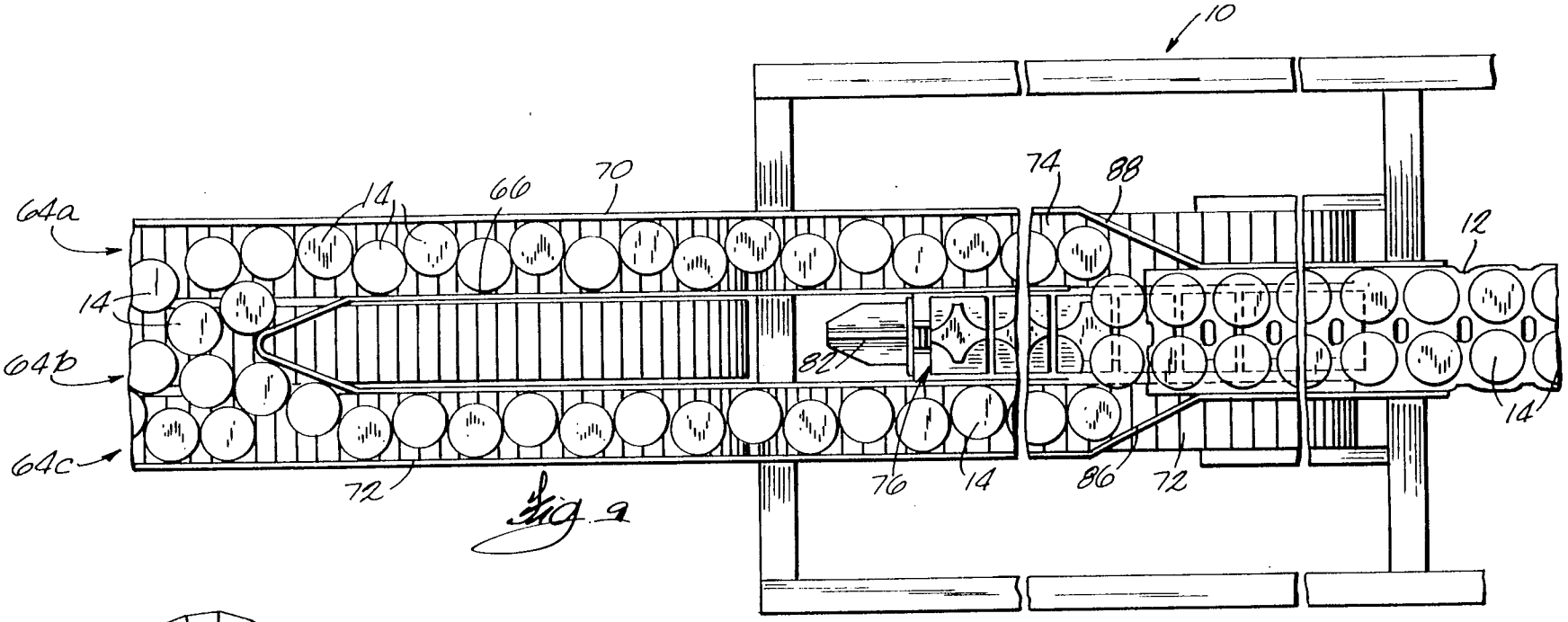
FIG. 9 is a cross-sectional view of the carrier assembling apparatus shown in FIG. 3 taken along line 9—9 thereof.

As illustrated in FIG. 3, the carrier assembly apparatus 10 further includes a conveyor for conveying the cans 14, in side-by-side relationship, along a linear path between the lower edges of the first and second discs 32 and 34. As best seen in FIG. 9, the conveyor includes an in-feed section 64 which supplies cans 14 to the machine. A splitter 66, extending along the midline of the in-feed conveyor 64 separates the cans 14 into two, separate, spaced, parallel files or rows 68 and 70. Following separation, the cans in each file are discharged onto a pair of spaced, parallel, conveyors 72 and 74 arranged to move slightly slower than the in-feed conveyor 64 so as to create a slight back pressure and thereby maintain can-to-can contact in each of the rows 68 and 70. Between the parallel conveyors 72 and 74, the carrier assembling apparatus 10 includes an intermediate conveyor 76 adapted to convey the cans 14 in pairs past the lower end of the carrier expander 16 assembly with constant side-to-side and front-to-back spacing substantially equal to the desired can spacing in the finished package.

Figure 10:
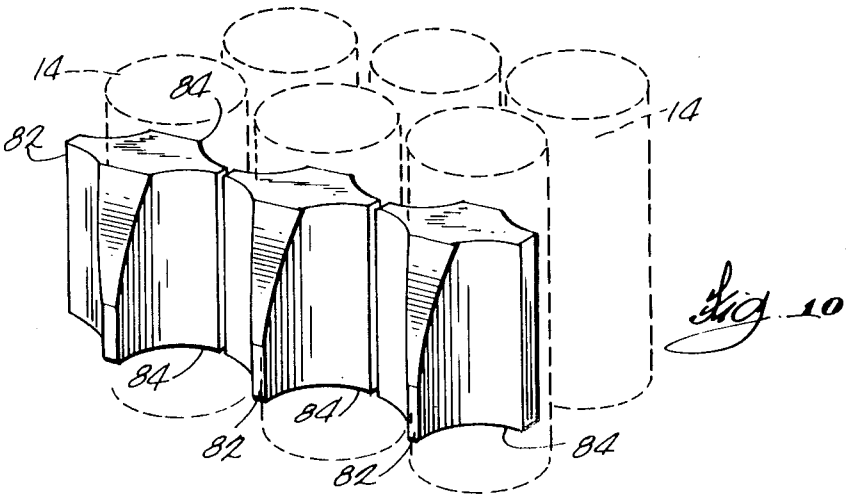
FIG. 10 is a diagramatic perspective view of a portion of a conveyor for conveying cylindrical containers in side-by-side relationship past the carrier expander assembly shown in FIGS. 1, 2 and 3.

The intermediate conveyor 76 is best seen in FIGS. 1, 2, 9 and 10, and includes a closed loop roller chain 78 carrying a plurality of regularly spaced, substantially rectangular, carrier plates 80 on its outer surface. An upwardly extending separator 82, preferably formed of molded plastic, is mounted to the upper surface of each carrier plate 80. As is best seen in FIG. 10, each separator 82 is shaped so as to form, in conjunction with the next adjacent carrier, a pair of substantially semi-cylindrical recesses 84, each dimensioned to receive one of the cans 14. The separators 82 extend between the two parallel rows of cans 14 and function to transport the cans in the desired side-by-side relationship along the path of travel.

As further illustrated in FIG. 9, a pair of inwardly angled deflectors 86 and 88, on opposite sides of the intermediate conveyor 76, function to deflect the cans 14 inwardly toward the intermediate conveyor 76 and thus into registry with the semi-cylindrical recesses 84 formed by adjacent ones of the separators 82.

Referring again to FIG. 3, the plastic carrier 12 is supplied from a bulk source, such as a reel 90, and means are provided for feeding the carrier 12 from the reel 90 onto the carrier expanding assembly 16 adjacent the point of minimum spacing between the first and second discs 32 and 34. In the illustrated embodiment, such means take the form of a driven, cylindrical drum 92 mounted for rotation around a horizontal axis 94. The cylindrical drum 92 includes a plurality of radially outwardly extending pins 96 spaced and dimensioned to fall into registry with the finger holes 20 formed in the carrier 12 between adjacent pairs of the semi-circular cutouts and also with paired apertures 18. In addition, the reel 90 is supported above the in-feed conveyor 64 for rotation around a substantially vertical axis 98, and one or more guides 100 support the moving carrier 12 between the reel 90 and the drum 92. Rotation of the drum 92 pulls the carrier 12 from the reel 90 and feeds the carrier to the discs 32 and 34. As best seen in FIG. 4, a generally planar carrier in-feed chute 102 supports the carrier 12 as it is discharged from the drum 92 and, as best seen in FIG. 3, feeds the carrier 12 to the carrier expanding assembly 16 along a line tangent to the first and second discs 32 and 34 adjacent their upper ends.

The first and second discs 32 and 34 are rotated by means of individual sprockets 104 and 106 mounted to the outboard face of each disc 32 and 34 and engaged by separate, driven chains 108 and 110. The sprockets and chains are arranged so that each of the first and second discs rotate in a counter-clockwise direction as viewed in FIG. 3, whereby the lower periphery of each disc moves in the same direction, and at substantially the same speed, as the cans being transported by the intermediate conveyor 76. Thus, the relative velocity of the carrier 12, carried adjacent the lower side of the carrier expander assembly and between the first and second discs, is substantially the same as the velocity of the cans 14 being transported by the intermediate conveyor 76.

Preferably, the separate in-feed conveyor 64 and the parallel side conveyors 72 and 74, and the intermediate conveyor 76, the carrier in-feed drum 92, and the first and second discs 32 and 34 of the carrier expander assembly 16 are each driven by a single power source such as an electric motor 112. In addition, the various drive mechanisms are preferably arranged so that a constant, fixed spatial relationship is maintained among the shoe assemblies 30, the expanded carrier 12, and the tops of the cans 14 at all times. In particular, the relationship is such that, as each can 14 passes beneath the lower peripheries of the first and second discs 32 and 34, the top of the can is received in an expanded aperture 18 of the carrier 12.

As illustrated in FIG. 4, when the unexpanded carrier 12 is first fed from the drum 92 to the first and second discs 32 and 34, opposed pairs of the holding plate 46 along the disc peripheries extend into the carrier apertures 18 so as to engage the outermost side edge 44 of each cutout 18. At this time, the outer side edge 114 of the carrier 12 lies in a substantially horizontal plane between the outer side 52 of the holding plate 46 and the carrier support chamfer 54, and over the arcuate recess 56. As the first and second discs 32 and 34 rotate in synchronization around their respective shafts 38 and 40, the holding plate 46 moves outwardly relative to each other thereby expanding the size of each aperture 18 to a degree sufficient to allow the top end of a can 14 to extend into the expanded aperture. At the same time, the side of the carrier 12 touching the holding plate 46 slides, under the tension of expansion, along the finger in the direction shown by the arrow in FIG. 6(*b*), causing the carrier 12 to turn inwardly and eventually assume the substantially vertical orientation shown in FIG. 7(*a*). In this manner, the carrier support 48, and in particular the arcuate recess 56, functions to control the twisting of the carrier 12 during expansion and thereby control the orientation of the carrier 12 as it is assembled with the cans 14. As further illustrated in FIG. 7(*a*), the height of the carrier expander assembly 16 above the intermediate conveyor 76 is such that the expanded carrier 12 is positioned just below the rim of the can lid 116 and along the can chime 118.

To ensure positive disengagement of the expanded carrier 12 from the holding plate 46 of the first and second discs 32 and 34 and onto the side-by-side cans 14, the carrier assembling apparatus 10, in further accordance with one aspect of the invention, includes a rolling depressor in the form of a third disc 120 oriented for rotation in a substantially vertical plane midway between the first and second discs 32 and 34. As best seen in FIGs. 1 through 3, the rolling depressor 120 is of somewhat smaller diameter than either of the first and second discs 32 and 34. In addition, the rolling depressor 120 is mounted to rotate freely around a center 122 located below, and downstream of, the centers of rotation of the first and second discs 32 and 34. In this embodiment, the rolling depressor 120 engages the carrier upstream of initial engagement of the carrier with the cans and for a distance thereafter to engage the carrier over the can tops. The depressor 120 then rotates about axis 122 under the influence of carrier 12 as the carrier is pulled onto the traveling cans by driven discs 32 and 34, and to some degree the traveling cans exerting a pulling force on the carrier after it is fitted over the tops of the cans. As illustrated, the diameter of the rolling depressor 120 is such that its lowermost periphery contacts the center web 124 of the carrier 12 between adjacent cans 14 and holds the center web 124 below the rims of the adjacent cans so as to disengage the carrier 12 from the holding plate 46 as each finger passes through its lowermost point during its rotation around its respective axis of rotation. Preferably, the thickness of the rolling depressor 120 is such that the depressor 120 imparts a V-shape to the center web 124 of carrier 12 between the cans 14 as best seen in FIGS. 1, 7(*a*) and 7(*b*).

Figure 3A:
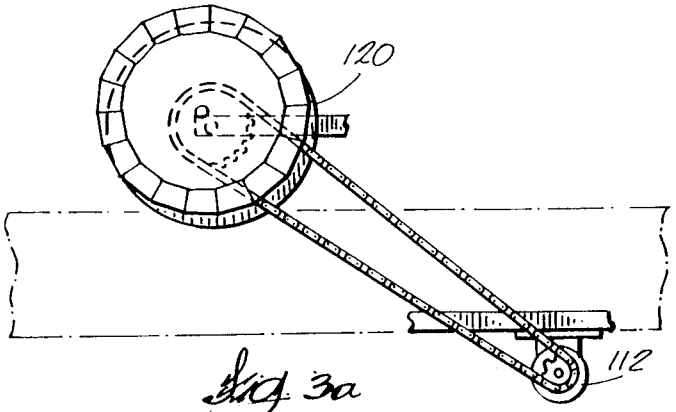

In an alternative embodiment, FIG. 3*a*, rolling depressor 120 is driven by the single power source, motor 112, in synchronization with driven discs 32 and 34, the conveyors, and the feed drum 92.

The carrier assembling apparatus described herein, and, in particular, the canted-disc carrier expander, provides a simple, durable and economical mechanism for automatically assembling plastic carriers onto a plurality of containers. Although the apparatus has been shown and described in the context of twelve-ounce beverage cans, it will be appreciated that, by changing the shape of the shoes, as well as the size of the canted discs and their orientation to each other and to the conveyor, the invention can be readily adapted for use with containers of other sizes and shapes. Finally, although a particular conveying apparatus has been shown and described, it will be appreciated that the invention can be adapted for use with conveyors of types other than those herein shown and described.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. An apparatus for installing a plastic carrier onto a plurality of containers arranged in side-by-side relationship, said apparatus comprising first and second pluralities of members adapted to engage the carrier and arranged to rotate around non-coincident substantially intersecting axes so as to expand the carrier for installation onto the containers.

2. An apparatus in accordance with claim 1 further comprising means for moving the cans in side-by-side relationship into registry with the expanded carrier.

3. An apparatus in accordance with claim 2 further comprising means for disengaging the expanded carrier from said members and onto the containers following expansion of the carrier.

4. An apparatus in accordance with claim 3 further comprising means for feeding the carrier from a bulk source and into engagement with said members.

5. An apparatus in accordance with claim 1 wherein said first plurality of members is mounted on the periphery of a first rigid disc-like structure, and wherein said second plurality of members is mounted on the periphery of a second rigid disc-like structure.

6. An apparatus in accordance with claim 5 wherein said first and second rigid disc-like structures each comprise a substantially planar solid disc.

7. An apparatus in accordance with claim 1 wherein each of said members comprises a shoe assembly.

8. An apparatus in accordance with claim 7 wherein each of said shoe assemblies includes an arcuate holding plate shaped to extend into an aperture formed in the carrier, and further includes a carrier support alongside the shoe and adapted to controllably guide the carrier into a desired orientation on said shoe during expansion of the carrier.

9. An apparatus in accordance with claim 1 wherein said first and second pluralities of carrier engaging members are carried on first and second discs and including means defining axes of rotation for said first and second discs and wherein said axes are divergent one from the other.

10. An apparatus in accordance with claim 6 wherein means for disengaging said expanded carrier comprises a third disc and including means for rotating said first, second and third disc in synchronization.

11. An apparatus for installing a plastic carrier onto a plurality of substantially cylindrical cans arranged in side-by-side relationship, said apparatus comprising:

means defining a pair of first and second non-coincident substantially intersecting axes;

a first disc mounted for rotation around said first axis;

a second disc mounted for rotation around said second axis;

means for simultaneously rotating said first and second discs in the same direction and at substantially the same speed around said first and second axes; and engaging means adjacent the outer periphery of said first and second discs for engaging opposite sides of the carrier so that said carrier is expanded as said outer peripheries diverge during rotation of said first and second discs around said first and second non-coincident substantially intersecting axes.

12. An apparatus in accordance with claim 11 wherein the plastic carrier comprises an elongate strip having therein formed a plurality of opposed apertures and wherein said engaging means are adapted to engage the carrier within the apertures and adjacent the sides of the elongate strip so as to expand the sides of the carrier outwardly during rotation of said first and second discs.

13. An apparatus in accordance with claim 12 wherein each of said members comprises a shoe assembly.

14. An apparatus in accordance with claim 13 wherein each of said shoe assemblies includes an arcuate holding plate shaped to extend into one of said apertures, and further includes a carrier support alongside the holding plate and adapted to controllably guide the carrier into a desired orientation on said holding plate during expansion of the carrier.

15. An apparatus in accordance with claim 11 further comprising conveying means for conveying the cans in side-by-side relationship past said first and second discs and into registry with the expanded carrier.

16. An apparatus in accordance with claim 15 wherein said first and second discs are mounted above said conveying means and are oriented so that the point minimum spacing between the peripheries of said first and second discs is farthest from said conveying means, while the point of maximum spacing between said peripheries of said first and second discs is nearest said conveying means.

17. An apparatus in accordance with claim 16 wherein said first and second discs rotate so that, at said point of maximum spacing between said peripheries of said first and second discs, said peripheries move in substantially the same direction, and at substantially the same speed, as the cans conveyed by said conveying means.

18. An apparatus in accordance with claim 17 further comprising means for disengaging the expanded carrier from said engaging means and onto the cans when the expanded carrier is adjacent said point of maximum spacing between said peripheries of said first and second discs.

19. An apparatus in accordance with claim 18 wherein said means for disengaging comprises a rotary depressor either powered or freely turning mounted for rotation in a substantially vertical plane substantially between said first and second discs.

20. An apparatus in accordance with claim 11 further comprising a rotary depressor mounted for rotation in a substantially vertical plane substantially between said first and second discs.

21. An apparatus for installing a plastic carrier onto a plurality of cylindrical cans arranged in side-by-side relationship, said apparatus comprising:

a conveyor arranged to move the cans in side-by-side relationship along a substantially straight line of travel;

a first rigid disc positioned over and adjacent one side of the conveyor and mounted for rotation around its center in a first plane substantially parallel to said line of travel;

a second rigid disc positioned over and adjacent the other side of said conveyor opposite said first rigid disc and mounted for rotation around its center in a second plane skewed relative to said first plane and substantially parallel to said line of travel;

said first and second planes being oriented so that the outer peripheries of said discs are spaced closest to each other where said peripheries are farthest above said conveyor and are spaced farthest from each other where said peripheries are closest to said conveyor;

a first plurality of shoes carried adjacent said outer periphery of said first disc and adapted to engage and retain one side of the carrier;

a second plurality of shoes carried adjacent said outer periphery of said second disc and adapted to engage and retain another side of the carrier opposite said one side;

means for simultaneously rotating said first and second discs in the same direction and at substantially the same speed around their respective centers so that opposed ones of said first and second pluralities of shoes remain opposed throughout rotation of said first and second discs, and so that the portion of the carrier engaged and retained by a particular opposed pair of said first and second pluralities of shoes is stretched and thereby expanded as said particular pair rotates from the point of minimum spacing between said outer peripheries toward the point of maximum spacing between said outer peripheries;

means for feeding the carrier into engagement with said first and second pluralities of fingers adjacent said point of minimum spacing; and means for disengaging the carrier from said first and second pluralities of shoes and onto the cans adjacent said point of maximum spacing between said peripheries of said first and second discs.

22. An apparatus in accordance with claim 21 wherein said means for disengaging the carrier comprises a rolling depressor adapted for rotation in a third plane between said first and second rigid discs and intersecting said line of travel.

23. An apparatus in accordance with claim 22 wherein said rolling depressor comprises a third rigid disc mounted for rotation around an axis below the centers of said first and second rigid discs and downstream of said centers in the direction of said line of travel.

24. An apparatus in accordance with claim 21 wherein said first and second rigid discs rotate around respective first and second non-coincident substantially intersecting axes.

25. An apparatus in accordance with claim 21 wherein said means for feeding the carrier comprises a rotatable driven drum adapted to engage and convey the carrier in response to rotation of said drum.

* * * * *